US006169484B1

(12) United States Patent
Schuchman et al.

(10) Patent No.: US 6,169,484 B1
(45) Date of Patent: Jan. 2, 2001

(54) PERSONAL LOCATION SYSTEM

(75) Inventors: Leonard Schuchman, Potomac, MD (US); Lloyd Engelbrecht, The Sea Ranch, CA (US)

(73) Assignee: ITT Manufacturing Enterprises, Inc., Wilmington, DE (US)

( * ) Notice: Under 35 U.S.C. 154(b), the term of this patent shall be extended for 0 days.

(21) Appl. No.: 09/292,366

(22) Filed: Apr. 15, 1999

Related U.S. Application Data

(60) Provisional application No. 60/083,096, filed on Apr. 28, 1998.

(51) Int. Cl.[7] ..... G08B 23/00

(52) U.S. Cl. ..... 340/573.1; 340/573.4; 340/539; 340/825.36; 340/825.31; 340/825.49; 379/38

(58) Field of Search ..... 340/573.1, 573.4, 340/573.3, 573.5, 539, 825.36, 825.31, 825.49, 825.06, 825.54; 379/38

(56) References Cited

U.S. PATENT DOCUMENTS 5,731,757 * 3/1998 Layson, Jr. ..... 340/573.1
5,742,233 * 4/1998 Hoffman et al. ..... 340/573.1
5,838,237 * 11/1998 Revell et al. ..... 340/573.1
5,870,029 * 2/1999 Otto et al. ..... 340/825.36
5,917,425 * 6/1999 Crimmins et al. ..... 340/825.49

* cited by examiner

*Primary Examiner*—Nina Tong
(74) *Attorney, Agent, or Firm*—Jim Zegeer

(57) ABSTRACT

A monitoring and location system comprising a service center from which movement to and from a prescribed local area and a prescribed wide area is to be monitored. Each member of a class being monitored is provided with a personal RF transponder unit (RFTU). Each RF transponder unit has a digital electronic identification number (DEIN) embedded therein for transmission by RF upon request. RF transceiver interrogation units define specific egress/ingress zones for the prescribed areas. Each interrogation unit being connected to the service center to god signal (1) when an RFTU has egressed or ingressed a prescribed area and (2) the DEIN embedded therein. The RF transceiver interrogation units can determine distance and bearing to a given RFTU and DEIN. When there are a plurality of cell sites encompassing the prescribed areas, an RF transceiver interrogation unit at each of the cell sites, respectively, are connected to the service center. Each RFTU has an emergency signalling component which, when activated, causes a range and bearing measurement to that RFTU to be made and sent to the service center for action.

2 Claims, 9 Drawing Sheets

FIGURE 3

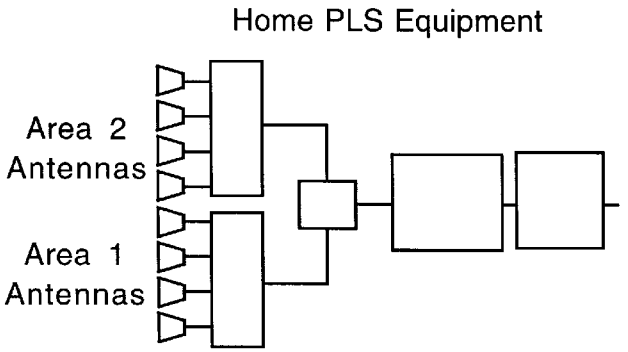

•Perimeter Transceiver is low power version of cell site equipment with telco inteface.
•Interrogation initiated (alarm system "ON") by doors opening/closing.
•Exit areas (area 1) alternately interrogated with perimeter area (area 2) to differentiate departure from arrival.
•Request for service can always be made from perimeter area (system"on").
•PLS can be coupled with conventional alarm system integrating PLS with intrusion protection, fire protection, IR motion sensing, etc.

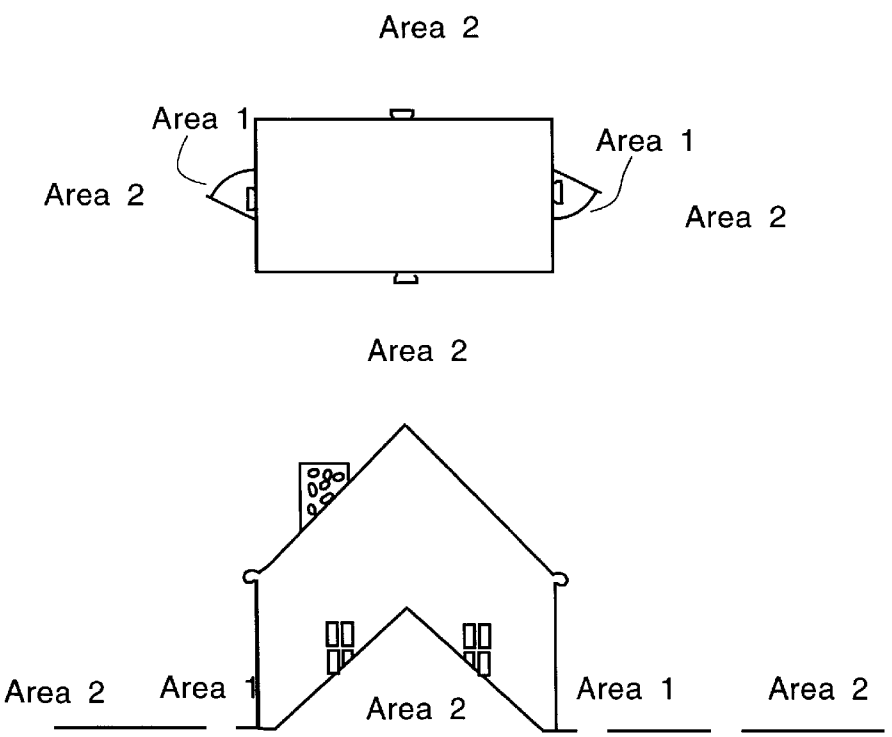

PERSONAL LOCATION SYSTEM

REFERENCE TO RELATED APPLICATION

This invention is the subject of provisional application Ser. No. 60/083,096 filed Apr. 28, 1998 and entitled PERSONAL LOCATION SYSTEM.

This invention relates to a Personal Location System (PLS). One exemplary purpose of a PLS system is safety tracking used as an aid to locate people or animals, conceivably objects, but mostly for people and animals and especially those who are not necessarily able to care for themselves. As an example, it could be for children that wander outside of a building and you want to know when they go out, or it could be children that wander away from the yard. In which case it is assumed that they are not aware that they could be in personal danger and you can find them. Another example would be for people that can easily become confused or disoriented who might want or need to be tracked. As they go in and out of a house or beyond the yard (or some defined area) and possibly become disoriented, they might want assistance to get to where they want to go and could trigger for assistance or guidance. If someone else wants to know where they are, that action can be accomplished without the disoriented person's knowledge. It requires no voluntary action on the user's part to be located, but it can be used on a voluntary basis, that is, self-initiated if necessary. The system covers two specific areas, one is a local or internal area that would be very localized, to be within a home, within a school or a nursery or a hospital as examples, and the system identifies when a subject transitions between this local area and the wide area. It can, however, also respond to an emergency service request initiated by the individual in that zone. The second area we describe is a wide area or exterior area. In this case, the invention applies within a neighborhood or a town or city or metropolitan area, e.g. away from the person's usual home or nursery. In this particular case, the system does a personal radio interrogation and determines position involuntarily by transmission by the user's set. It does a bearing and range check, preferably using range and bearing measurements as disclosed in our application Ser. No. 09/025,092 filed Feb. 17, 1998 for POSITIONING SYSTEM FOR CDMA/PCS COMMUNICATIONS SYSTEMS or our application Ser. No. 60/038,838, filed Feb. 18, 1997 for A PHASE AGILE ANTENNA FOR USE IN POSITION DETERMINATION. Again in this area, an emergency service request would be honored, and that could be initiated by the individual himself.

Thus, the object of the invention is to provide a personal location system for local and wide areas which is low in cost and is highly effective.

DESCRIPTION OF THE DRAWINGS

The above and other objects, advantages and features of the invention will become more clear when considered with the following specification and accompanying drawings wherein:

FIG. 3 is an illustration of the personal location system alarm/response system.

DETAILED DESCRIPTION OF THE INVENTION

Figure 1:
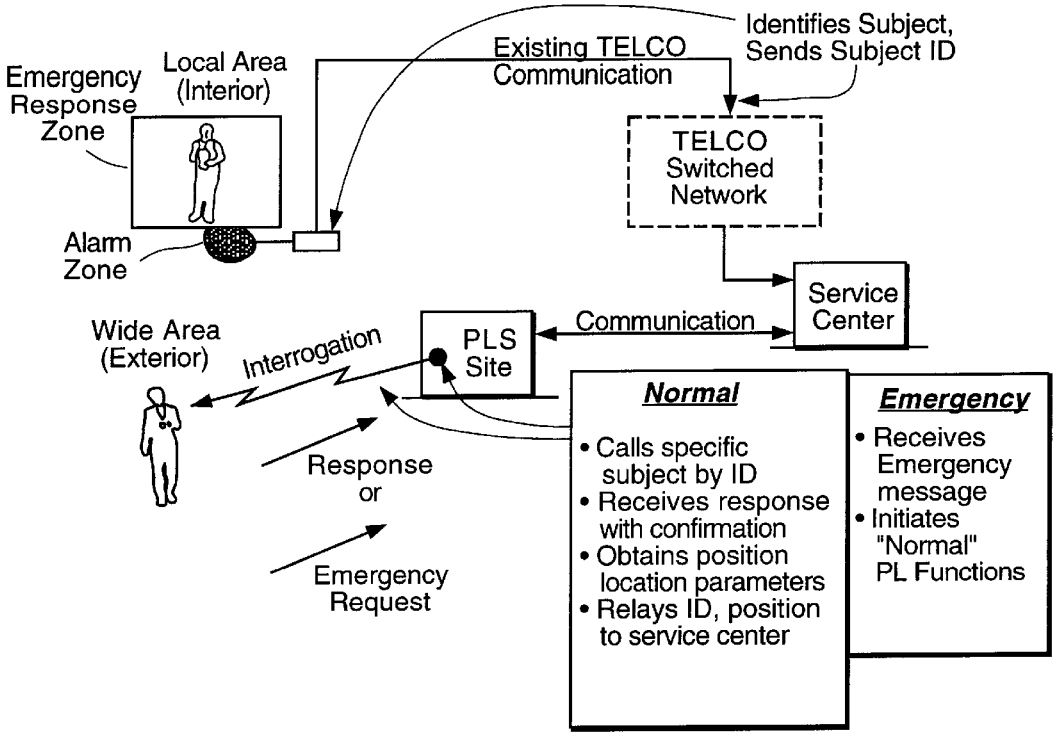
FIG. 1 is an illustrative diagram of a personal location system incorporating the invention.

Referring to FIG. 1, the user's transceiver operates in two ways. One is by self-initiation, that is the individual pushes a button, in which time the key element is that he sends out an RF signal containing his own ID so that someone else knows who to respond to. A second mode is by responding to the system RF transmissions which are initiated either by local equipment or by wide area equipment that broadcasts the user's ID; and the user's receiver, seeing its ID registered in its receiver, responds with the transmission so that the other end of the system can accomplish its actions necessary for personal location or warning.

The block diagram shown in FIG. 1 illustrates some of these functions. The upper left-hand corner depicts an Alarm Zone and an Emergency Response Zone, and this is for the local area or so-called interior. Interior in this case may be the boundary of the yard as well as the boundary of a home. In the case of the home, the alarm zone would be usually set up around places the person under surveillance would go in and out of, the zone that one is expected to stay in. As an example, one could easily provide alarm or sensing zones on the front and back door to a house. If a child is instructed to stay in the house, then those alarm zones would be set so that if the child left the house an alarm signal is generated. The emergency response zone may include not only the interior of the house but out into the yard as well, in which case if someone were in trouble, they could seek help by pushing the emergency response button. The local area system is connected to a service center that acknowledges these transitions or changes, and in most cases this connection would be by the existing telephone system employing a digital modem. This is much like many of the alarm systems that exist now that dial up when there is intrusion by burglars, fire, etc. Incidentally alarm systems can be tied into such a system as well. In such case, if the alarm zone is entered, the system dials up the service center and identifies the subject and sends his ID over that Telco switch network to the service center so that the service center is now aware of who has left an alarm zone and can take appropriate action.

The lower part of FIG. 1 illustrates the wide area or exterior area. Again, interaction with someone in the wide area can happen in two ways:

1. The service center and the personal location system site can trigger an initiation by an interrogation in which case the user transceiver responds, or
2. If the user is in trouble and pushes the emergency response button, then the transmission is accomplished without the participation of a first transmission by the PLS site.

In normal operation, the service center calls an individual by a specific subject ID. The ID system will be discussed later. The service center receives a response with the confirmation that the right person is answering the call, and the personal location system then obtains location parameters that it determines by itself. It primarily does a range-to-range and bearing operation on the user, and it relays this ID and position to the service center. The PLS, of course, is a variation of a cell in a cellular system, and there would be many of them, and they are all tied back into the service center. In the emergency mode, the user presses the emergency message button (see user set PU), and the PLS system receives this data and sends it on to the service center. The service center then acts just like it did during the normal call. If goes out with the specific user ID that it just received and follows the steps in the normal process and the result is that the service center knows where the subject is.

"Personal Location System Service Types"

First of all there is the Emergency Response Services. That operates anywhere, whether its a local area or a wide area. Just push the button and you get help. But it is activated by the subject. In other words, it takes some overt action on the part of the subject to cause that to happen. Secondly, the Surveillance and Location Service that operates anywhere, local or wide area, but in this case it does not need the subject to do anything outside of wear the transceiver. It automatically functions without the user knowing it. Thirdly, there is the Location Service, which primarily is only wide area and is usually done by a third-party request. Remember that the second Surveillance and Location Service may be triggered by someone going through an alarmed area, which signals the system to keep track of this person's ID and know where it is, whereas the location service can be triggered by a third party, saying I need to know where someone else is.

Figure 2:
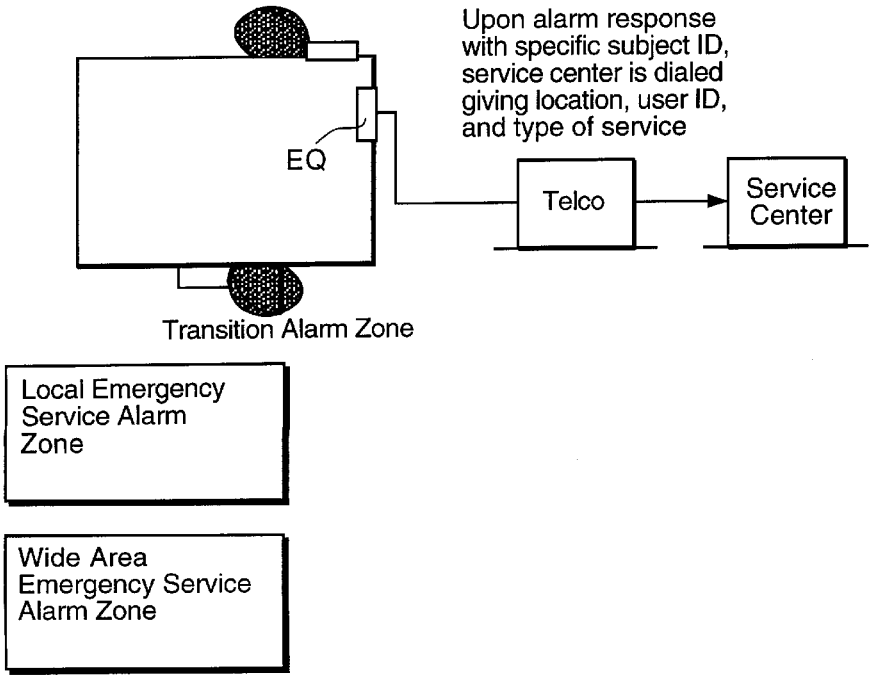
FIG. 2 is an illustration of the personal location system local area diagram.

The diagram shown in FIG. 2 is an example of a Personal Location System Local Area. The diagram shows a home with two doors and areas called the Transition Alarm Zones and an area around the house identified as the Local Emergency Service Alarm Zone. It will be remembered that this is the "local" emergency service alarm zone. Outside of the range, it is intended that these local areas be very low-power, short-range operations and implemented with transmitters in both the alarm zones and in the emergency service zones so that the user's transceiver recognizes it in an area where it is not supposed to be and sends back a response to the system. FIG. 2 also shows a component equipment box EQ which interfaces with the Telco system so that it can do the dial-up service to a service center. Everything else outside the gray zone is identified as the emergency service alarm zone. There are transmitters that are located in the "local" emergency service zone. These are very low-power units because "every house could have one" and it avoids interference; but there is also the "wide" area emergency service alarm zone which is serviced by a transmitter. So there are times when a person can actually be in two zones, e.g. be serviced by two means, one the local emergency service as well as the wide area emergency service because in truth they overlap. And this gives redundancy which is considered a reliability feature.

The local area alarm response system in FIG. 3 typically illuminates the areas around the house and at the doors and so forth with very small (RF) spot beams (at least one of the doors area 1), and slightly larger (RF) spot beams in the various areas 2. These transmitters are not on unless triggered, and the device that causes the two areas to be illuminated is an opening closing of the doors on either area one which turns on the transmitters and says OK we have an alarm condition here and we're going to need to keep track of an individual. The transceivers used are a very low-power version of what is essentially the cell site equipment with a Telco interface. The term "cell site" refers to the communication part of the cell site equipment in contrast to the ranging and bearing determination part of the system. The interrogation is initiated, that is the alarm is on, by doors opening and/or closing. This says, "what happened" when the door is open; turns on the transmitter and sends out a request. The user unit responds back, of course, giving his ID. Since the system is half duplex, area one regions and area two regions are alternately interrogated then, and by telling, with a little bit of time, that a person has gone from an area 1 to an area 2 you know they are leaving the property. On the other hand, if they left and are coming back and the system is on, therefore area 2 would be triggered and then area 1 which says how they came back home. Thus, the system can derive information about which way people are going and how serious the condition is. Requests for service can always be made from the perimeter area. Anytime the person under surveillance is in area 2, an emergency request can be made, and it will go through the Telco system in the local system to get to the service center. AS indicated earlier, there is nothing that prevents the system from being tied into other emergency systems such as burglar alarms and fire detection, stuff that's also reported in service centers as well.

Figure 4:
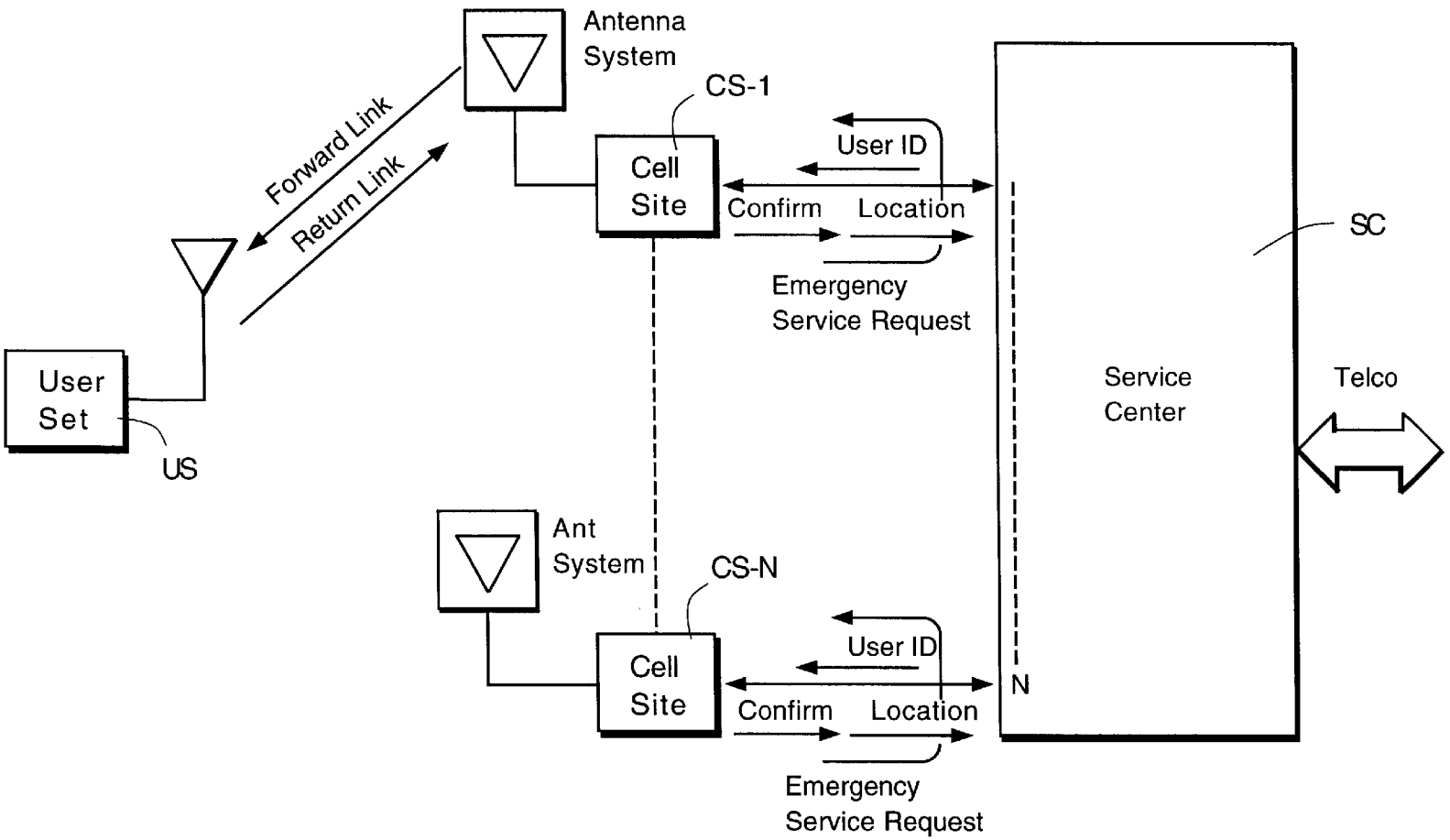
FIG. 4 is a block diagram of a personal location system wide area system diagram.

FIG. 4 is a block diagram illustrating transition to the wide area system or the Personal Location System Wide Area System. As shown, a user set US which is a transceiver having a forward and return link to a cell site CS. This is a PLS cell site. These cell sites can be provided in conjunction with Telco cell sites if desired. In other words, the cell site is only the required coverage. The forward and return link operate on a half-duplex basis. That is, when the cell site is transmitting, the user is listening, there is a blank time so that the user can respond on the same channel back to the cell site system. In an emergency request, the cell site receives this request, strips off the user ID and makes a request of the user to respond to its ID. This is done so that the antenna system can get a bearing measurement and a two-way range measurement. All the communications are confirmed by identifying that the right user is responding. There are as many cell sites as necessary to cover the wide area in a locality, a neighborhood, a city, etc. as desired. The service center SC, again, is tied to the Telco system and can respond back to the third party interrogatories which in many cases may be someone at the local area itself.

Figure 5:
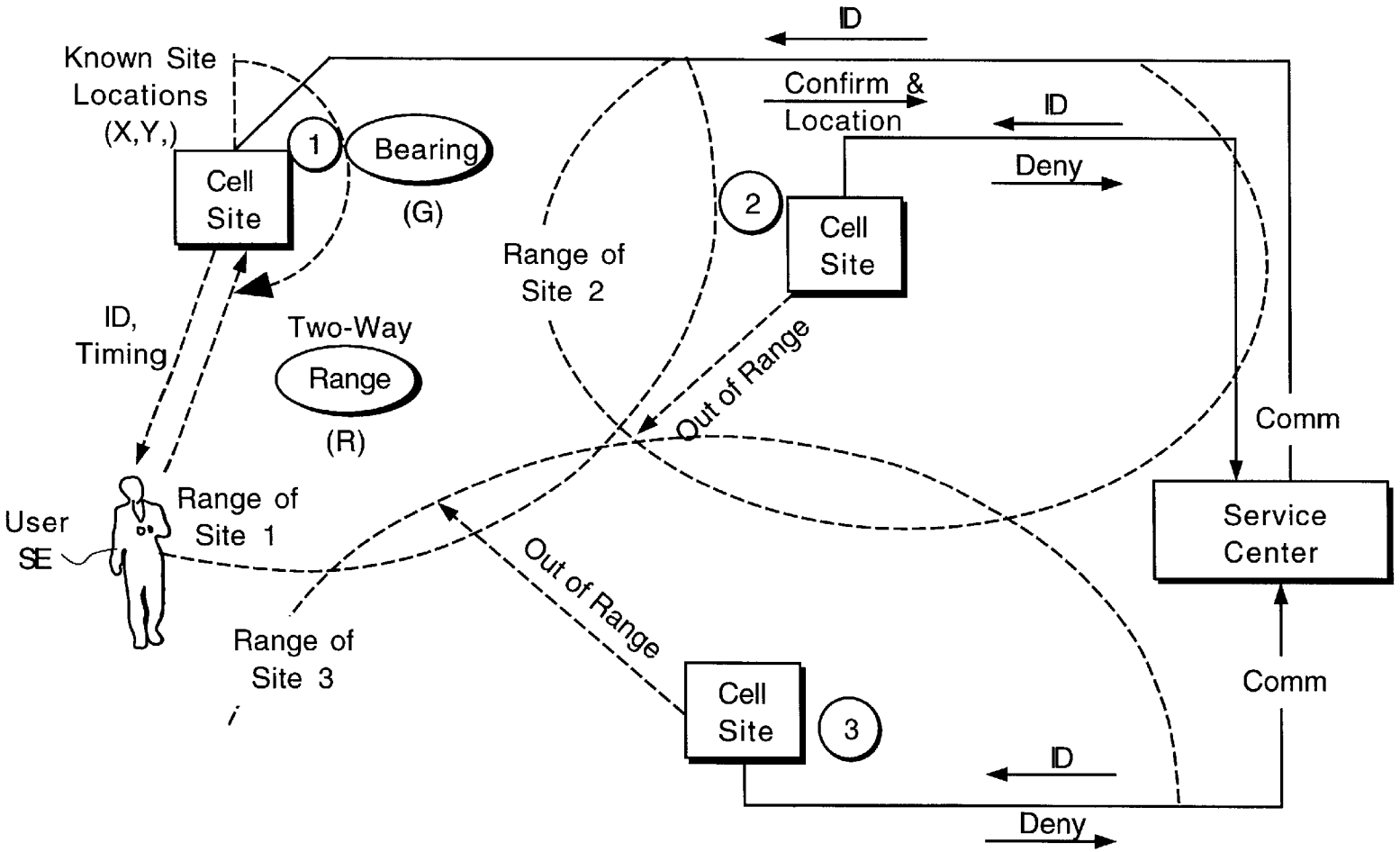
FIG. 5 is a diagrammatic illustration of a personal location system wide area sensing, with a plurality of cell sites.

FIG. 5 illustrates a PLS System Approach (Wide Area) and shows how the wide area PLS system operates. In this diagram, three cell sites are shown, all of which are connected to the service center. Each cell site has the ability to conduct a two-way range measurement on the user which gives the distance from the cell site and a bearing measurement which gives an angle with respect to a reference direction from the cell site. Since the cell sites are at known locations identified as "X" and "Y", and as a requirement for the PLS system to operate, the system must know the precise location of your antenna system, and each cell site has to be surveyed in some form. Any time the user, as an example, in cell site 1 region, goes beyond his coverage, he ends up in a different cell site's coverage area since as the user traveled towards the bottom of FIG. 5 and a little bit to the right, he would end up in cell site 3 as an example.

The system operates on a confirmation basis. As an example, say that one wanted to find user SE, and the system does not know where user SE is located, the request goes to the service center saying find user ID #. This ID request is sent out with the user's ID #, and only those user transceivers that have that ID # will respond, and in this case should be just one person (user SE) responding. In the particular example, the user is at the edge of cell site 1, so cell site 1 would recognize the response because it has the correct code that goes with responding to the ID and can therefore send back a confirmation in location of the user from cell site 1. Notice that the response in cell sites 2 and 3 is a deny. That is, no one answered the response, and therefore it is assumed that the person is not in that particular cell zone. It is conceivable that a person on the edge of the zone could respond in two different zones, because that person is at the edge of cell sites 1 and 3, then therefore this gives double confirmation, depending on the timing of the signal that was returned. There would be some ambiguity if the radii of the cell sites were different and one could resolve that easily in the service center.

Figure 6:
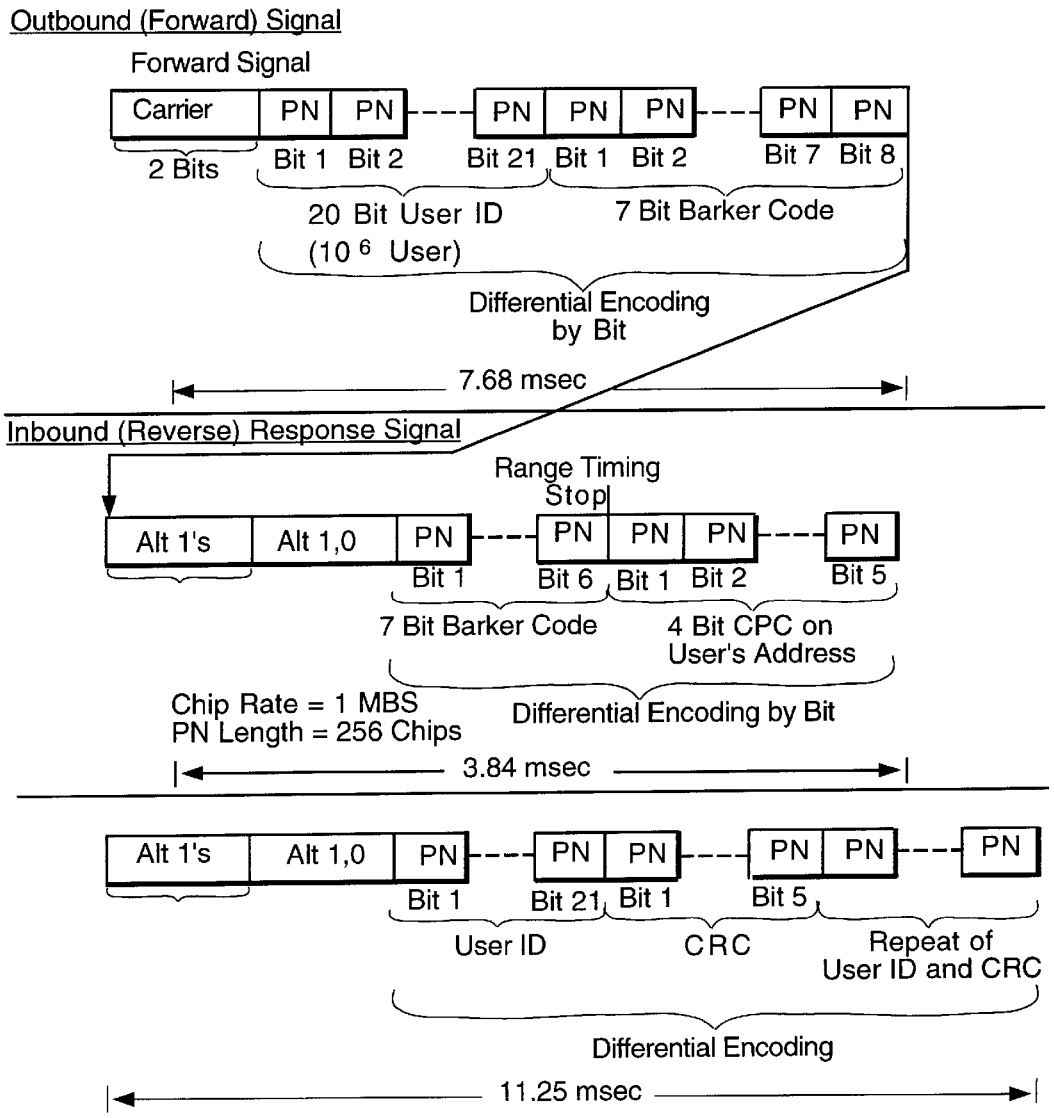
FIG. 6 is an illustrative example of the waveform definition for a PLS incorporating the invention.

FIG. 6 shows some of the signal structure in this disclosed embodiment. The Personal Location System Waveform Definition is in a preferred embodiment one that there is a PN code, that is, it is a spread spectrum system, and everyone in that area uses the same PN code. The outbound signal going to the user, which is shown in the top third of the FIG. 6 would consist of plain carrier with no PN sequence on it, and this is so that the user's receiver can be frequency corrected. Then there follows a 21-bit sequence which defines the user ID. This is a 20-bit user ID, but it is sent differentially, and therefore 21-bits are needed because it is the change between bits that defines the data content. This is the same PN sequence for each bit except phase reversal can occur to signify change. The 20-bit user ID is followed by a 7-bit Barker code which takes eight symbols, again because it is differentially sent. At the end of the last Barker code symbol, a timer is started in the cell site transceiver equipment to begin timing the two-way range operation.

The middle part of the diagram in FIG. 6 shows what happens at the user's set in response to this outbound signal by the cell site. At the end of the received 7-bit Barker code, the user sends a series of all ones. This is so that the cell site can carrier synchronize. Then it sends alternate ones and zeros, and this is so the cell site can get bit synchronization. And then the user sends back the locally generated 7-bit Barker code, which takes eight symbols, and then sends a 4-bit CRC (cycle redundancy code) that is derived from the user's own ID. This is a 4-bit symbol that is unique to the user's ID and is a confirmation to the cell site that the right user answered or responded. That response takes about 3.8 milliseconds. During that time, the cell site would have accomplished a two-way range and a bearing measurement to determine the user's location.

At the bottom of the diagram in FIG. 6 is illustrated the user's self-initiated emergency signal. It has some similarities to the response signal shown above it with the following exceptions: After the all ones, which cause cell site carrier synchronization, and the alternate ones-zeros which allows cell site bit synchronization, the PN sequence is used to transmit the user ID and CRC twice. The user ID is a 20-bit or 21-symbol sequence and the CRC is a 4-bit or 5-symbol sequence, and this entire ID CRC sequence is transmitted twice. The purpose for sending it twice is to improve the reliability of receiving the wide band signal. If the first user ID and its unique CRC check on that ID, turns out to be correct at the cell site, then it is used without regard for the second set of symbols; but if the first set does not check out with the CRC, that is, there was an error made in either the ID or the CRC, the second set is checked, and if that checks out good, then it is used. This provides an additional ability to survive phase hits and real fading, etc. All of the wide area, as stated earlier, which could be a neighborhood, a city, a metropolitan area (it could be anything) utilizes the same PN code. This process is used to make the user's receiver as simple as possible and therefore as inexpensive as possible. The feature that identifies a specific individual is his ID.

Figure 7:
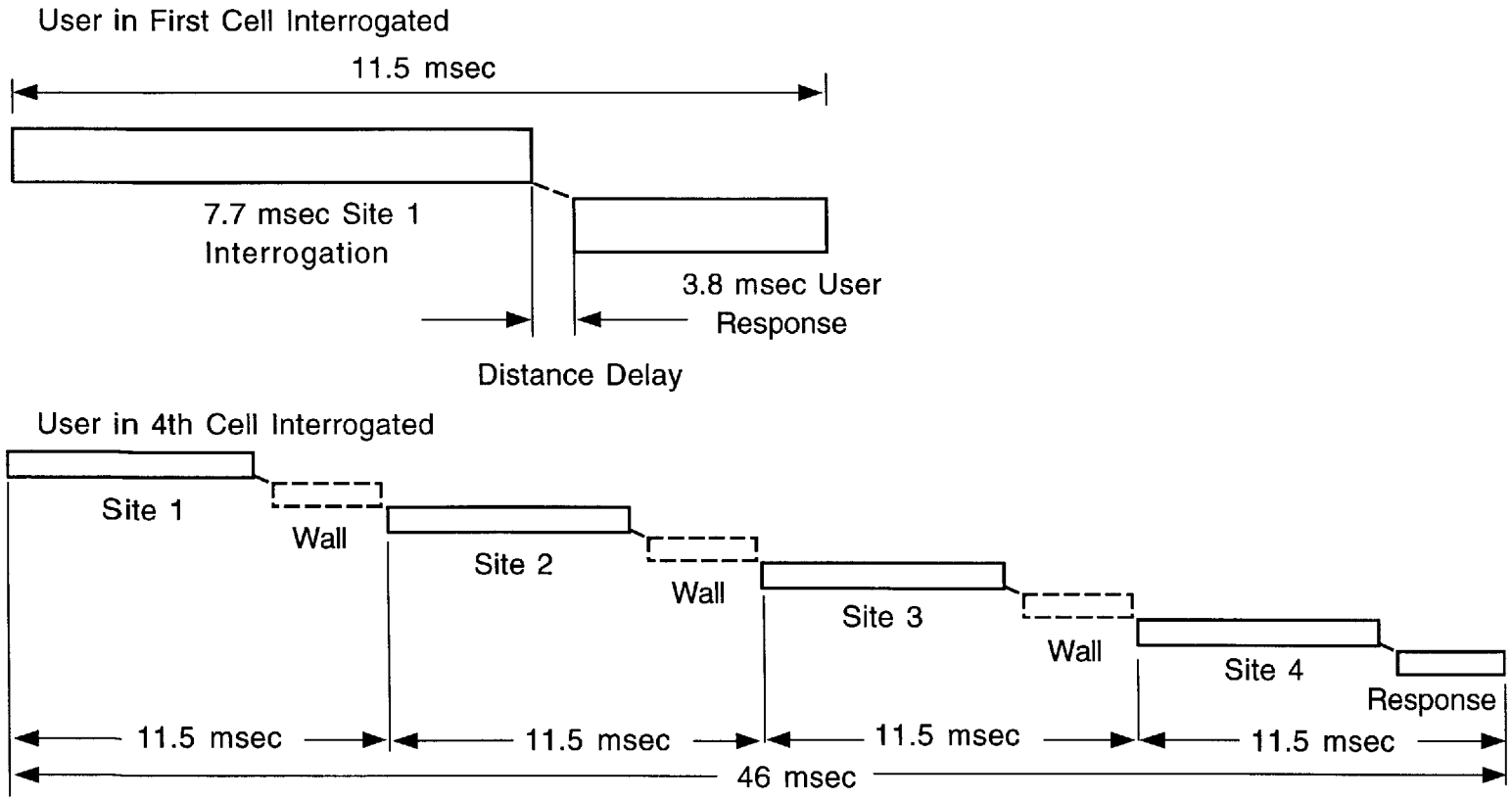
FIG. 7 is an illustrative example of a PLS timing diagram.

FIG. 7 shows some of the PLS timing which should be considered in relation to FIGS. 5 and 6. Assume that the system has asked for a position location s request on a particular user and that the user is in site one. The request goes out which takes about 7.7 milliseconds (See FIG. 6 for the timing). Then there is some distance delay, and then the user responds with the signal shown in the middle of FIG. 6 which is 3.84 milliseconds. The whole process takes about 11.5 milliseconds plus the delay time. This would then uniquely locate the user in cell 1. Where the user is not necessarily known, and each cell site is using the PN, it is not desirable to have them all go out all at once with the same user ID. So what is actually done in a cell organization is that a selected number of cell sites, for example, four cell sites, are sequentially interrogated. In this particular case, it is assumed that the user is in cell site 4, again site 1 would be interrogated, but there would be a wait for the user's answer, but since the user is not there, there would be nothing happening; site 2 would then go on the air and interrogate for the user, but since he's not there nothing would happen in his wait period; similarly for site 3, nothing would happen in response in its wait period; but in site 4 there would be a response because that's where the user is located. So now the user has been identified as in site 4 without causing interference, and you've identified where in site 4 that the user is. That whole process takes 46 milliseconds.

Figure 8:
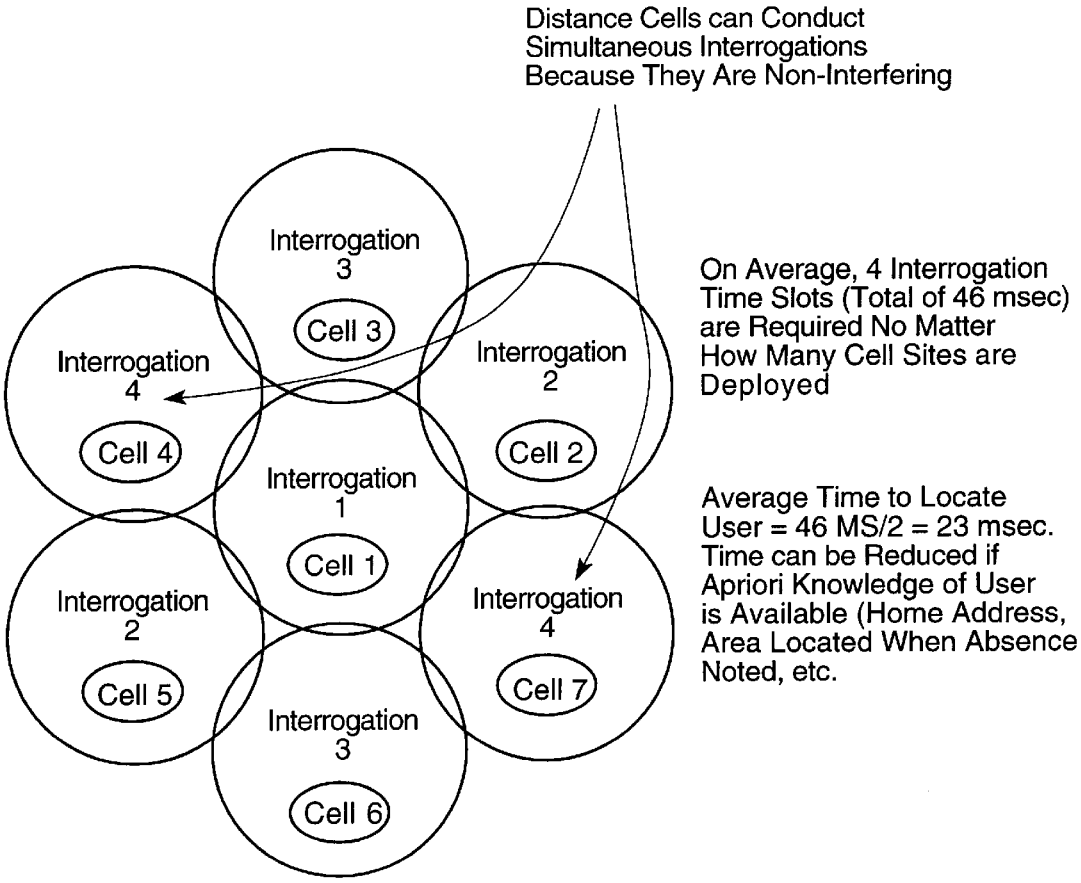
FIG. 8 is an illustrative example of the PLS interrogation process.

FIG. 8 shows the PLS Interrogation Process and how the system can use just four different cell site timing slots. If one looks at a standard cell configuration and seven of the seven cells are shown on this diagram, it will be seen sites 2 are on opposite sides of site 1 so they can be interrogated simultaneously, the same is true for sites 3 and 4. And if one were to continue the diagram, it is found that on the diagonals you would have a 434343 arrangement or a 212121 type of arrangement so the distant cells can conduct simultaneously interrogations, that is, all site 4 locations would interrogate for the user simultaneously, but only one would get an answer which uniquely identifies where the user is, and they are non-interfering. Similarly, this would happen with sites 3 and sites 2. Therefore, on average, only four interrogation time slots are needed or a total of 46 milliseconds no matter how many cell sites are deployed. The average time to locate a user is half of that since half the time he will be found in the first try, and the probability is 0.25 in any one time slot, so with four time slots that would be 23 milliseconds. If you have a prior knowledge, however, of where the user is, you can cut down the time and pull it closer to the 11½ milliseconds of response time. If, for example, you always tried the cells nearest to the individual's home or hospital or wherever they're located, its highly likely that you might get them there before he goes across the city. So using common sense in the service center can reduce the interrogation time significantly.

Figure 9:
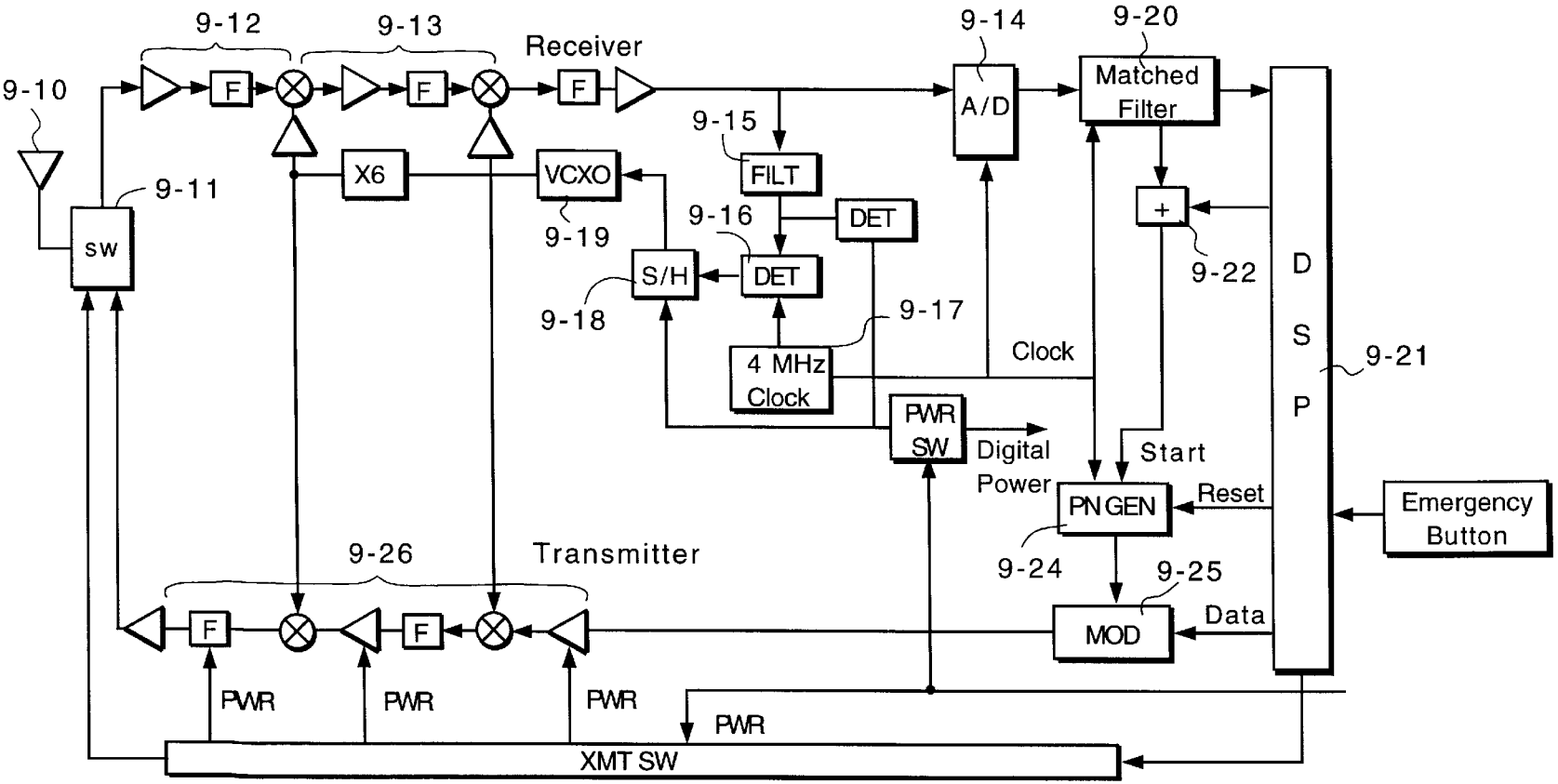
FIG. 9 is a block diagram of the user's equipment.

FIG. 9 is a block diagram of the "User set". AS stated earlier, the intent is to make it as simple as possible. Starting at the top of the diagram and going from left to right constitutes the receiver. The receiver is always active to the extent that it can detect when there is a signal on the air. Additional circuitry is turned on under certain circumstances so it has a more or less sleep mode that can still receive. The signal comes in the antenna 9–10 and then the switch 9–14 and goes to the upper part of the diagram which is an RF chain 9–12 and one or more stages of down-conversion 9–13 to provide an intermediate frequency which is shown after the second IF filter. IF sampling is used to convert the incoming signal to digital form and this is done in the A to D converter 9–14 which forms the bits that constitute the PN sequence. The signal is also locked by taking the filter path 9–15 and the phase detector 9–16 to the internal clock 9–17. The sampling and hold drive 9–18 to the VCO 9–19 to remove the frequency error so that the sampling of the IF does not have to account for much frequency error in the detection process. The detected bits out of the A to D converter 9–14 are fed to a matched filter 9–20 which is in essence the PN sequence matched filter. Since it is desired to get the benefit of all 256 bits of the PN sequence, one phase or another, and it is differentially encoded to enable comparing the PN sequence you had last time to the phase of the PN sequence you get next time and that determines the output data which is fed to the digital signal processor or DSP chip 9–21. The matched filter 9–20 also detects 9–22 the 7-bit Barker code sequence, i.e. each symbol of the Barker code sequence, and at the conclusion of that starts the transmitter which is the bottom chain. Since the system was receiving up to the last bit of the Barker PN sequence, after that there should be no more transmission from the cell site. The user set transmitter is turned on now and operates the half-duplex channel back towards the left (in FIG. 9) as a return channel to the cell site. The data which consists of either the 7-bit Barker code and the 4-bit CRC or the user ID, depending which mode the user set is operating in; remember if the user set if responding to the first transmission, it will be using the response signal and if it is generating the emergency sequence it will then be inputting its user ID and so far, so that data content changes depending on the type of message, but nonetheless, it modulates the PN sequence from PN generator 9–24 in modulator 9–25 and the signal is then amplified 9–26 in an RF sense and radiated out the antenna. The same local oscillator is used to transmit since the VCOs 9–19 and the oscillators 9–17 have been corrected in the receive RF chain and that information is held and the amount of error that the cell site sees in frequency return is substantially reduced so that the detection at the cell site is easy. At the conclusion of the last CRC transmission, the transmitter is again turned off by removing power so that the receiver is back in the receiver mode.

Figure 10:
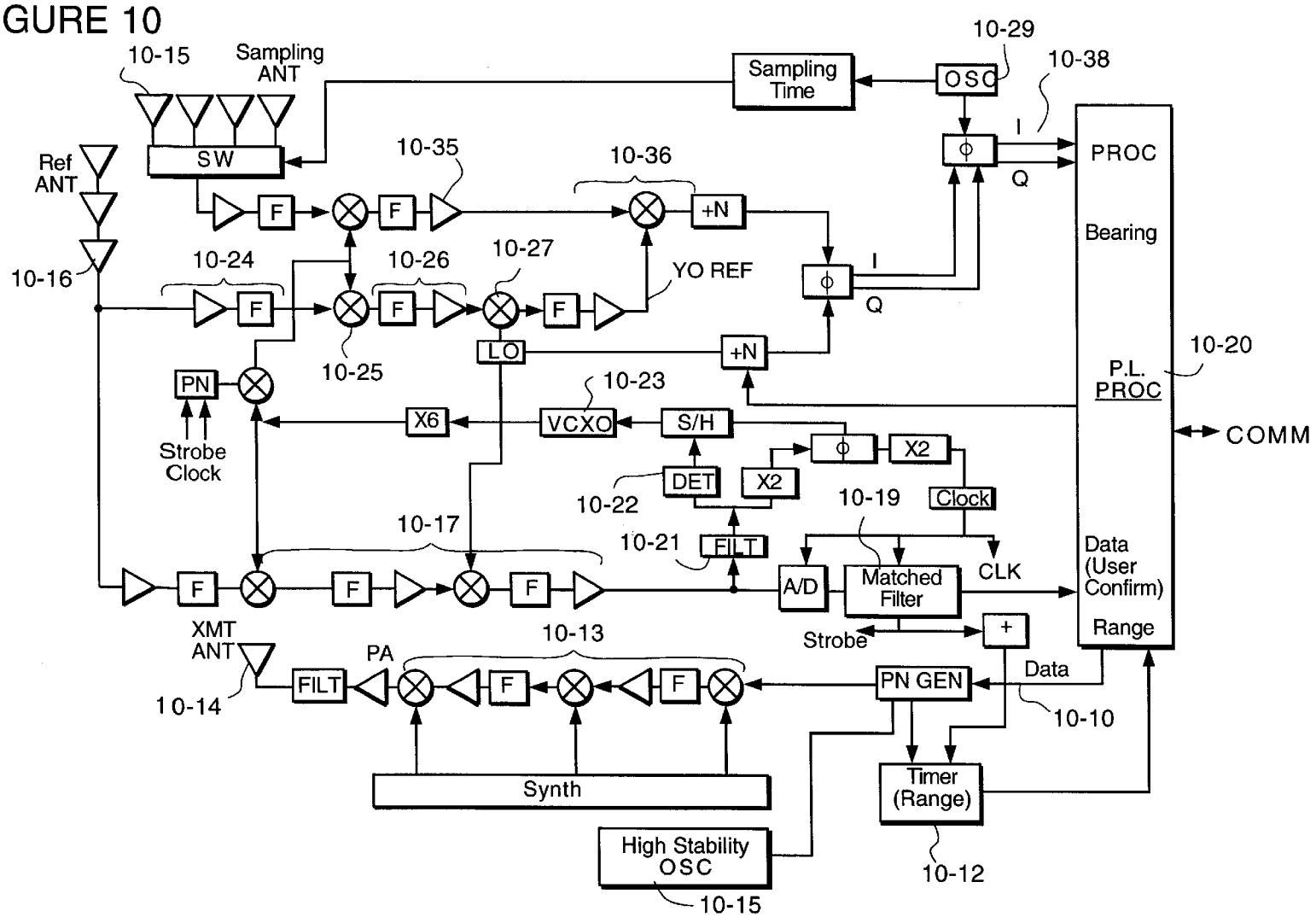
FIG. 10 is a block diagram of the cell site equipment.

FIG. 10 shows the Cell Site Configuration block diagram. This is substantially more complex than the user configuration, and here the discussion begins with the transmission part which is at the bottom of FIG. 10. The data 10—10 that is going out and referred to which is always the 20-bit user ID and the 7-bit Barker code is put on the PN generator 10–11 (which has a high stability oscillator 10–15) and sent out, and of course when the last bit of the Barker code is sent out it starts the range timer 10–12. These data in the PN sequence are then up-converted 10–13 through active frequency synthesis to go out the transmit antenna 10–14. In this particular case a separate transmit antenna is used.

The receive portion of FIG. 10 is the upper three-quarters of the diagram. The signal in the lowest part of the receive diagram will be discussed first, since that is the data channel. All of the circuit elements on the upper three chains, have to do with getting the range and bearing measurement. The signals received by the reference antenna 10–16 go to the bottommost part of that circuit and it is amplified, filtered and down-converted 10–17 to an IF which is A to D converted 10–18 using IF sampling and the data again passed through the match filter 10–19 and sent to the processor or DSP 10–20. In this particular case, the system does not have a prior knowledge of what the user ID will be so that the system accepts all of that data to digest and process. The signal at the IF is also filtered 10–21 and fed to detector 10–22 in a phase lock loop arrangement to correct the VCO 10–23 and, that is the detection system, takes out any additional residual error that is in the user's transmission back to the cell site. Upon receipt of the last bit of the CRC from the user in the response mode, the range timer 10–12 is turned off. Therefore, the system now knows the time a particular signal was sent out that the user returned it so the system now knows the distance from the cell site to the user's unit.

The top two chains on FIG. 10 accomplish the bearing measurement. The reference antenna 10–16 is used as one detection string and signals picked up by the reference 10–16 antenna are amplified and filtered 10–24 down-converted 10–25, filtered 10–26, and again down-converted 10–27, to produce a reference signal 10REF that comes from the reference channel. A very similar arrangement comes from the sampling antenna system 10–28 except only one of the sampling antennas is connected at a time. This is the equivalent of the phase agile rotating antenna disclosed in our application Ser. No. 09/025,093 except that it uses a sampled antenna instead of a rotating antenna. The sampled antenna signed is despread 10–35, downconverted 10–36, phase detected 10–37 to produce phase difference signal 10–38. Those two chains are used to determine the phase relative to a referenced direction, and the sampling is done in a precise sequence as determined by the sampling oscillator 10–29 so that the system knows in which direction it is looking. The phase difference signal 10–38 goes into the processor and interprets the phase difference as the angle from reference. So now the processor has the round-trip or two-way range timing, it has the user ID, and it has the bearing measurement so it knows unique user ID and location.

The recommendation is to use the unlicensed public band which is 902–928, which will allow for roughly 26 PN sequences to be used in a given area if there is sufficient to support that. There is also the 1910–1930 MHz band and the 2390–2400 MHz. Any of these are good, and in fact, the system will work at any frequency. These just happen to be unlicensed public band channels, and because we're using PN spread signal, it has a lot of interference rejection so other systems could afford to operate in the same band with caution, and we should still be able to operate. The channel, since its not expected to be high-density high-usage channel, should be half-duplex to minimize the complexity. We're using a PN spread at 1 MHz chip rate with 256 chips per bit which gives us about a 24 DB spread factor. We're also using differential by bit coding, that is since one bit occupies the same time duration as one entire PN sequence. It's also by differential by PN sequence to reduce the user's frequency stability requirements. The system needs to be stable only for the length of two PN sequences to get good detection, and therefore extreme frequency accuracy isn't required. But differential is also used to provide stability in a rapidly fading channel known as a "railing" channel so that using differential you get a much better error rate and precise absolute phase modulation. It is recommended that only one code be used, that is, one PN code for the entire large community to keep the user's receiver and transmitter expense down. That will handle a million users which gives a fairly large community to work with. But additional codes can be added, and it can be done right over the top of what you already have if you want more. You just have to put redundant equipment at the cell sites since you don't know which code the user would be using ahead of time you would have to have the system laying on each PN code that you use. But nothing prevents that from being done.

The antenna bearing determination is the same technique for the agile antenna system sampling elements around the circle. The time to a range to determination is totally under control of the system. The basic intent for this invention is to really reduce the requisite equipment and RF monitoring techniques to provide an extremely inexpensive receiver/transmitter combination for the user with very low power drain and long battery life and to provide it in an easily implemented service mode so that it can be implemented for those people that need to be watched or animals that need to be tracked, etc.

While the invention has been described in relation to preferred embodiments of the invention, it will be appreciated that other embodiments, adaptations and modifications of the invention will be apparent to those skilled in the art.

What is claimed is:

1. A monitoring and location system comprising:

a service center to monitor the movement of mobile objects to and from a prescribed local area and a prescribed wide area, a personal radio frequency (RF) transponder unit (RFTU) for each mobile object of a group being monitored, each RF transponder unit having a digital electronic identification number (DEIN) embedded therein for transmission by a radio frequency signal upon request from a radio frequency (RF) transceiver interrogation unit, wherein said prescribed local areas comprise a plurality of zones which includes egress zones and ingress zones; each zone has its own RF transceiver interrogation unit for monitoring the ingress and egress, respectively, of its own group of RFTUS; when an RFTU has egressed or ingressed one of said zones, said RFTU transmits its own DEIN to the RF transceiver interrogation unit of said one of said zones; when said RF transceiver interrogation unit received said DEIN, said RF transceiver interrogation unit transmit a signal includes said DEIN to said service center; and wherein said RF transceiver interrogation unit includes a distance and bearing detection for determining a distance and bearing between said RF transceiver interrogation unit and a RFTU;

wherein said prescribed wide area comprises a plurality of cell sites, each cell site having areas encompassing said prescribed local area and a second transceiver interrogation unit at each cell site, respectively, to communicate with each RFTU located within a respective cell site and an interrogator at said service center for interrogating each cell site to determine whether a give RFTU and DEIN is within a given cell site.

2. The monitoring system defined in claim 1 wherein at least some of said RFTU's include an emergency signal source which, when activated, is monitored by said cell sites and the cell site containing the RFTU which is the source of an emergency signal determines the bearing and distance from the center of the cell site to the RFTU which is the source of said emergency signal.

* * * * *